United States Patent [19]

Danker et al.

[11] Patent Number: 4,826,000

[45] Date of Patent: May 2, 1989

[54] CONTAINER FOR STORING CONTACT LENSES AND CONDITIONING THEM WITH A LIQUID THAT RELEASES GAS

[75] Inventors: Fred J. Danker, Boonton Township, Morris County, N.J.; Thomas P. Hayes, Waterdown, Ontario, Canada

[73] Assignees: Chiba Vision Inc., Mississauga, Ontario, Canada; Stockwell Ventures Inc., Panama, Panama

[21] Appl. No.: 128,641

[22] Filed: Dec. 4, 1987

[51] Int. Cl.[4] ..... B65D 85/38; A61L 2/18

[52] U.S. Cl. ..... 206/5.1; 206/459; 215/230; 215/261; 215/332; 422/300; 422/310

[58] Field of Search ..... 206/5.1, 459; 215/230, 215/259, 261, 321, 329, 330, 332, 337; 220/367, 373; 422/300, 310

[56] References Cited

U.S. PATENT DOCUMENTS

| | | | |
|---|---|---|---|
| 2,351,150 | 6/1944 | Sanford | 215/232 |
| 3,035,589 | 5/1962 | King | 206/5.1 |
| 3,997,049 | 12/1976 | Sherman . | |
| 4,011,941 | 3/1977 | Parsons | 206/5.1 |
| 4,138,029 | 2/1979 | Mahoney | 206/459 |
| 4,231,489 | 11/1980 | Malone | 220/367 |
| 4,396,583 | 8/1983 | LeBoeuf | 206/5.1 |
| 4,579,823 | 4/1986 | Ryder | 215/230 |
| 4,625,899 | 12/1986 | Stull | 220/367 |
| 4,637,919 | 1/1987 | Ryder et al. | 422/300 |
| 4,750,610 | 6/1988 | Ryder | 206/5.1 |

FOREIGN PATENT DOCUMENTS

| | | | |
|---|---|---|---|
| 0788757 | 10/1935 | France | 215/332 |
| 1019115 | 1/1953 | France | 215/332 |

*Primary Examiner*—Jimmy G. Foster

*Attorney, Agent, or Firm*—Frishauf, Holtz, Goodman & Woodward

[57] ABSTRACT

A storage container or carrying case for contact lenses has a screw-on cap on which baskets for hanging the lenses vertically inside the canister are swingably suspended on a hinge plate which also holds the annular gasket for the cap closure when it is screwed down on the canister. A single helix thread on the outside of a tubular extension of the canister, for meshing with a similar internal thread on the rim of the cap, has a vertically running gap of a few degrees in width and a shallow channel is recessed in the flat flange surface just below the threading at the same orientation as the gap in the thread. The tightness of the closure is thereby readily adjustable to prevent leakage of a treating solution for the lenses from the closed canister in the event that it is knocked over while at the same time permitting escape of gas when the treating liquid includes hydrogen peroxide and a wafer is provided near the flat bottom of the canister to activate or modify the peroxide action.

4 Claims, 3 Drawing Sheets

CONTAINER FOR STORING CONTACT LENSES AND CONDITIONING THEM WITH A LIQUID THAT RELEASES GAS

The present invention concerns containers for contact lenses for facilitating the soaking, storing and rinsing of contact lenses which are also useful as lens carrying cases.

The containers known from U.S. Pat. No. 3,997,049 comprise a fluid-tight type enclosure about 4 cm high comprising a canister and a threaded cap. Within the cap, and hinged thereto, are a pair of basket-like lens receptacles with perforated bottoms and lids. A hinge mounting allows the receptacles to be folded inwardly to confront one another before being inserted within the canister. With the cap removed from the canister the lens receptacles can be swung apart. The arrangement makes it easy for the user to recognize the left and right lens receptacle without the need of a good enough vision to read indicia on the baskets or lids.

The ascepticizing fluid in which the lenses are immersed was often heated. In the known containers above described, the closure produced by screwing on the cap was gas-tight.

In recent years it has been found desirable to ascepticize contact lenses in a liquid containing hydrogen peroxide in the presence of a disk or wafer, usually at the bottom of the liquid, which acts as a catalyst or agent to modify the activity of the peroxide. The peroxide containing liquids and the catalyst disks are sold as proprietary products without disclosing their precise contents. What is important for the container is that gas is evolved in their use and must be allowed to leak out of the container if and when pressure builds up, whereas if the container is knocked over, it is undesirable the liquid to leak out.

SUMMARY OF THE INVENTION

It is an object of the invention to provide a container for storing and conditioning contact lenses, particularly overnight, in a manner that allows gas to escape when a peroxide-containing liquid is used for conditioning and does not allow the liquid to spill if the container is knocked over.

Briefly, the threads on the canister are interrupted over a few degrees of the circumference and within those few degrees there is also a shallow cavity in the surface against which faces the rim of the cap when the cap is screwed down, so as to assure a passage for gas escaping from the canister. An annular gasket is provided inside the cap radially outward of the hinge plate which fits inside the top of the cap, extending radially out to the internal threading of the cap. When the cap is screwed down, the top of the externally threaded tubular wall of the canister is seated on the gasket. A flange of the canister limits the screwing down of the cap and has the shallow depression above mentioned. The flange permits the screwing down of the cap to be normally set quite easily so that liquid will not leak out while evolving gas is permitted to escape.

The invention is further described by way of illustrative example with reference to the annexed drawings, in which:

FIG. 1 is a side elevation of the container with the cap screwed down as in normal use;

FIG. 2 is a cross section of the canister or "base" of the container with the addition of a broken-line circle showing the position in which the lens holders are to be suspended when the cap is in place;

FIG. 3 is a side elevation of the canister with the cap removed, shown in the same attitude as shown in FIG. 1;

FIG. 4 is a cross section of the cap in a position which it would have when screwed down on the canister of FIG. 2 when the plane of the drawing passes in the narrow gap between the two baskets in their storage and conditioning position;

FIG. 5 is a bottom view of the cap showing the lens baskets in their facing position which is used for storage and conditioning; and FIG. 6 is a side view of the cap, partly in section, at right angles to the cross section shown in FIG. 4.

BRIEF DESCRIPTION OF THE DRAWINGS

The way in which the lens baskets are swung out when the cap is removed from the canister in order to load the lenses into them or remove the lenses from the baskets does not need to be described here, because the manner in which the baskets are moved and used is shown in the aforesaid U.S. Pat. No. 3,997,049.

FIG. 4 shows a cross section of a cap in a position it might have when screwed down from the canister in FIG. 2, while

Figure 1:
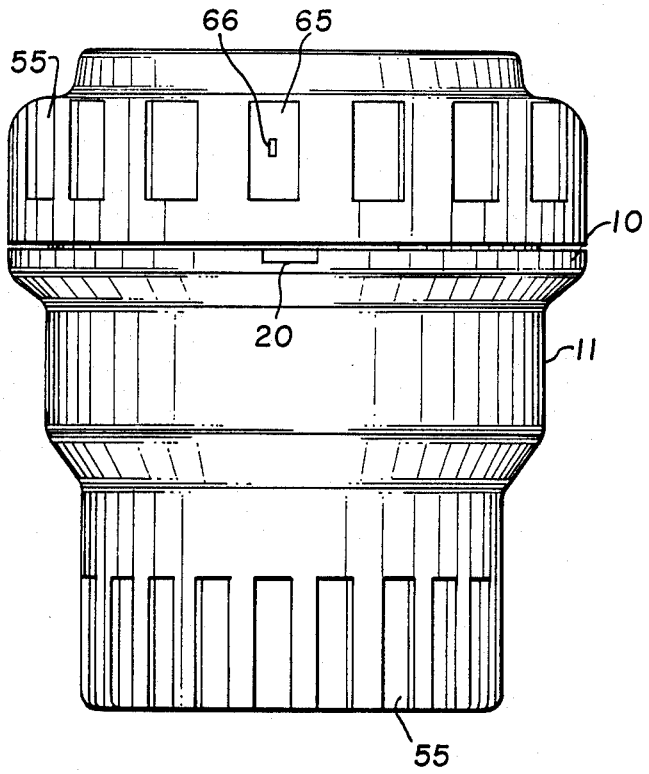
FIG. 1 shows the closed container with the cap 10 normally screwed down onto the canister 11.
Figure 3:
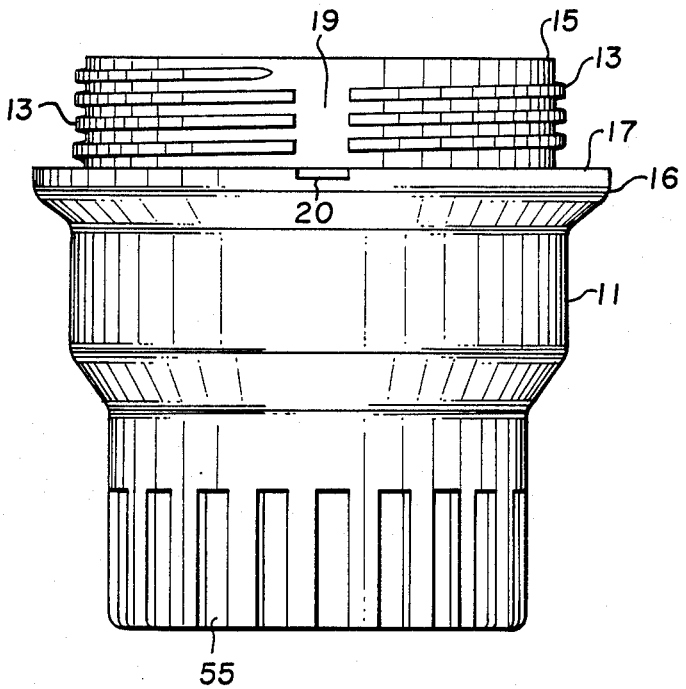
FIG. 3 shows the canister 11 in the same position as in FIG. 1, with the cap removed. The threads 13 on the exterior of the tubular projection 15 are visible in FIG. 3 and likewise the flange 16 having a flat surface 17 which limits the screwing down of the cap 10, or at least would provide such a limit if it were desired to compress the gasket tightly enough to prevent escape of gas. The gap 19 in the threads 13 also appears in FIG. 3 and likewise the shallow recess 20 in the flange 16 and its surface 17. This recess appears as a lateral opening 20 in FIG. 1.
Figure 2:
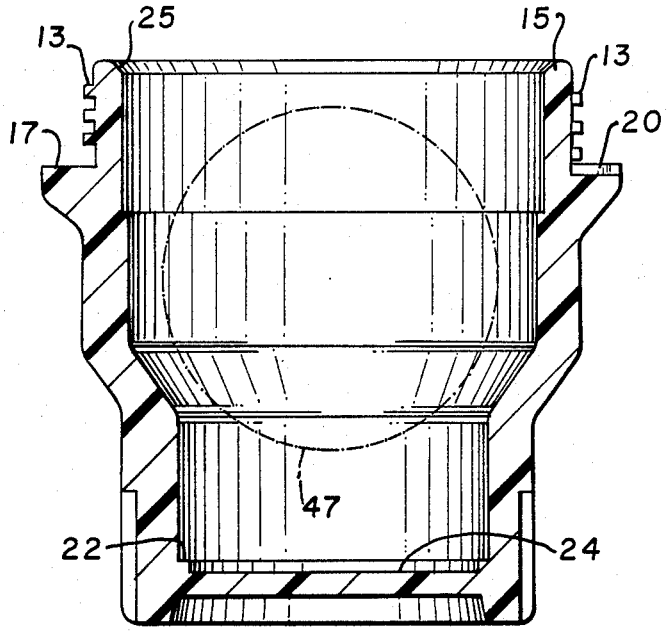
FIG. 2 shows a cross section of the canister or base of the container. The threading 13 is shown here in a manner which is conventional in working drawings rather than by drawing in the individual screw threads. A shoulder 22 is provided near the flat bottom 24 of the canister for supporting a thin disk of activating or catalyst material leaving a space between the disk and the bottom of the canister cavity. Such a space makes it easy for the disk to drop out of the canister after the canister is emptied, especially if the invented canister is lightly tapped on the upturned bottom. The upper portion of the canister is wider than the lower portion in order to accomodate the lens baskets. A small internal bevel 25 reduces slightly the contact area of the upward tubular extension 15 against the gasket provided in the cap, so that the tightness can be more readily adjusted by twisting the cap.
Figure 4:
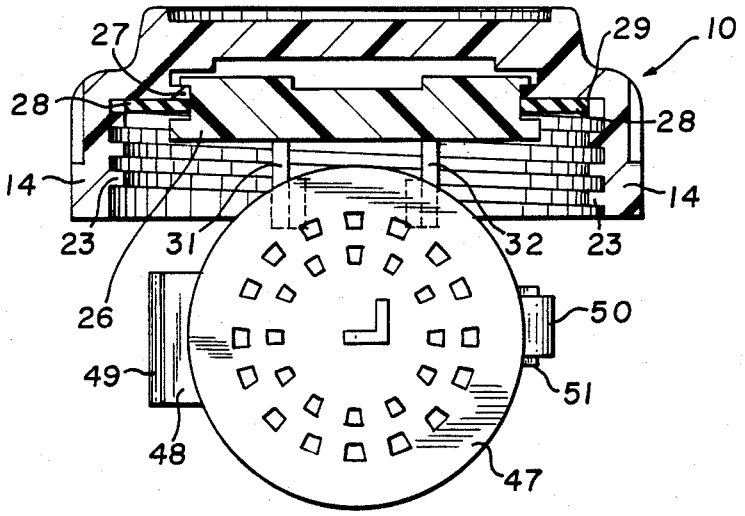

The hinge plate 26 is a disk made so that it can be snapped into place behind a small reentrant ridge 27 on the inside of the cap, this being done after the gasket 28, made of resilient material, is first mounted on the hinge plate 26, so that the gasket then is retained in the immediate neighborhood of a flat downward-facing annular surface 29 of the cap against which the gasket is seated when the cap is screwed down.

Four fixed hinge members 31, 32, 33 and 34 are affixed on the hinge plate 26, being preferably molded integrally therewith.

Figure 5:
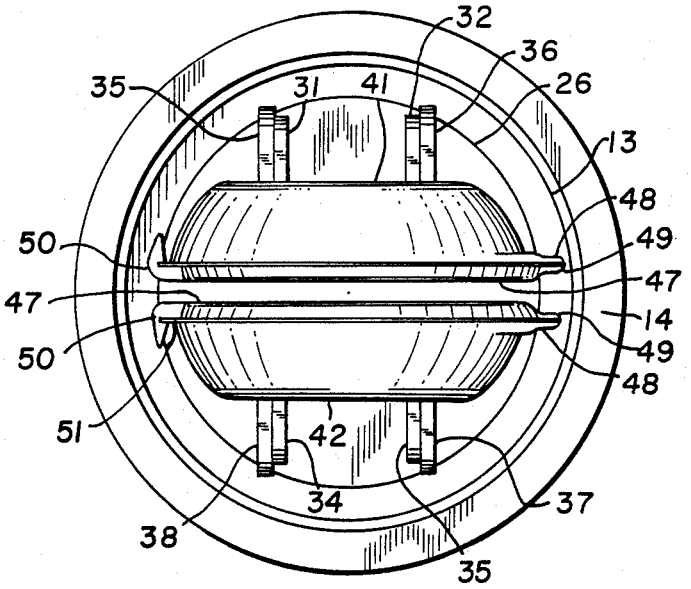
FIG. 5 shows a bottom view of the cap and FIG. 6 shows a side view, partly in section, at right angles to the cross section shown in FIG. 4. The internal threading 23 which engages the external threading 13 of the canister is shown in the same symbolic way as the threading 13.

As shown in FIG. 5, these hinge members are flat pieces, with their width oriented perpendicularly to the gap between the lens baskets in their storage position.

Figure 6:
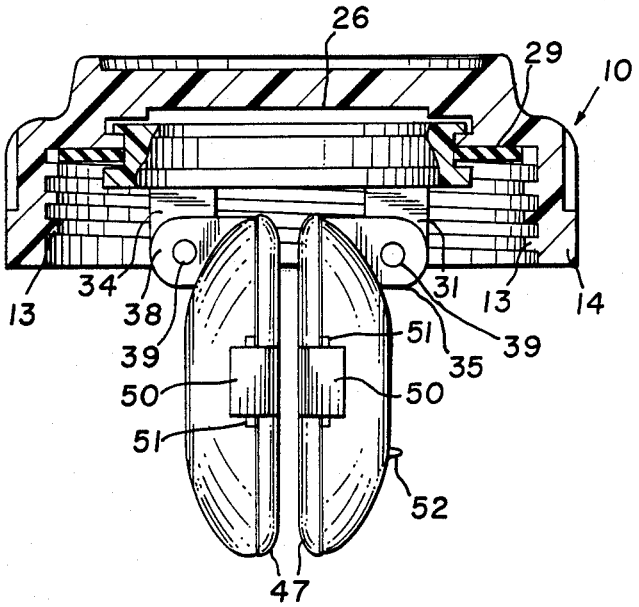

The lens baskets have flat hinge plates 35, 36, 37 and 38, the plates 35 and 36 being molded onto the bottom of the basket 41 and the hinge plates 37 and 38 being molded onto the bottom of the basket 42. The hinge plates 35 and 36 are spaced farther apart than the hinge members 31 and 32 and likewise the hinge plates 37 and 38 are spaced farther apart than the hinge members 33 and 34 so as to fit on outward facing surfaces of the hinge plates 31 and 32 as shown. FIGS. 6 shows that a hinge pin 45 is molded onto each of the hinge members 31, 32, 33 and 34 of the hinge plate 36, for passing through a hole in the corresponding hinge plates 35, 36, 37 and 38 of the baskets. The hinge plates of the baskets can thus be snapped over the hinge pins 45 to mount the baskets so that they can be swung out in the usual way when the cap is removed and placed upside-down to support the baskets, which can then be swung out for loading or unloading the contact lenses.

Each basket is made integrally with a lid 47 and a hinge strip 47 connecting the lid to the basket and very thin in the portion 49 where it folds over to close down the lid onto the basket where it snaps into the closed position by means of a catch 50 which, as better seen in FIG. 7, slips over a small flat tab extending outward from the basket edge at the catch location. As also shown in FIGS. 5 and 6, a small blunt thorn 52 is molded onto the bottom of the basket for the lens for the right eye so that this basket can be located by feel when the user has no visual acuity.

For the practice of the invention it is important that the pressure of the tubular extension 15 of the canister against the gasket 28 should easily be resettable. The bottom of the canister and the upper portion or mid-portion of the cap are provided with fluting grooves 55 which are useful for opening the canister by twisting off the cap or closing the canister by twisting the cap on. In order that the closure pressure may be readily resettable the threading of the cap and of the tubular extension 15 of the canister is a single helix so as to provide an unambiguous starting point. The fluting recess or depressions 55, for example the depression 65 shown in FIG. 1, can show by its position relative to the shallow channel recess 20 in the canister whether the cap is set for the desired container tightness. A small recess or boss 66 may be used to identify the particular fluting feature which should be opposite the channel 20 when the assembly provides a liquid-tight closure that permits escape of gas. A satisfactory closure prevents the escape of a water solution by gravity, as for example when the closed container is knocked over, even though it may be possible with that state of the closure to expel a drop of solution by violent shaking. Once the user gets used to the feel of the correct closure, visual checking of the kind just mentioned is in practice no longer necessary.

The pressure exerted against the gasket also tightens the engagement of the threads, so that the tightness of the closure is controllable in the final stage of the screwing down of the cap.

The arrangement of the invention also makes it possible to expel some excess solution through the channel 20 as the cap is screwed down in the event that more solution than necessary was filled into the canister and the excess liquid then comes out at a predictable location of the joint between the cap and the canister, namely the channel 20. Although the invention has been described with reference to a particular illustrative example, it will be understood that modifications and variations are possible within the inventive concept. For example the interruption of the threading may be provided on the cap instead of on the tubular extension 15 of the canister, in which case the recess 20 may be provided in the downward facing flat surface at the periphery of the cap instead of in the flange 16 of the canister.

The canister and cap as well as the hinge plate are preferably made of a strong and temperature-resistant plastic. The baskets are preferably made of a plastic that has some flexibility, so that the "live" hinge for the lid will be sufficiently pliable while having a long surface life. The gasket is preferably made of silicon. The cap, hinge plate and canister may for example be made of a material available commercially under the name "Noryl" and the baskets out of a material commercially available under the name "Polypro".

We claim:

1. A container for storing contact lenses and for treating them with an asepticizing liquid from which gas may evolve, comprising a canister having a base end for standing on a level flat surface and upper end having a cylindrical tubular extension having external threading and extending above an upwardly flat outward flange of said canister, and a cap having an internally threaded flat-bottomed rim for screwing down on said tubular extension of said canister, having an internal hinge plate held in said cap for suspending lens baskets in said canister and for allowing them to be swung out when the container is open and having an annular gasket held between said hinge plate and said rim for receiving the top of said tubular extension of said canister and wherein, for facilitating the establishment of a closure that is liquid-tight while permitting escape of evolved gas:

said external threading of said tubular canister extension and said internal threading of said cap each being a single helix thread, molded onto a cylindrical surface, a gap being provided in one of said single helix threads, running vertically and having a width of a few degrees of thread circumference, a shallow recess being formed in one of the flat surfaces respectively of said rim and of said flange, which flat surface belongs to the same body on which said single helix thread is interrupted by said gap, said recess extending over a few degrees of periphery of said same body at the same circumference orientation as said gap, and the periphery of the body having a said flat surface which faces said recess having surface features serving to indicate rotary position, within a substantial fraction of a revolution, relative to said recess, whereby said resettable adjustment of closure between said gasket of said cap and said tubular extension of said canister is facilitated for producing a closure capable of preventing leakage of aqueous liquid when said cap is knocked over while permitting escape of gas.

2. A container as defined in claim 1, wherein said gap is provided in said single helix thread of said tubular canister extension and said recess is formed at the surface of said flange, said surface features serving to indicate rotary position relative to said recess being provided on the periphery of said cap.

3. A container as defined in claim 1, wherein said tubular extension of said canister has an end surface which includes at least one circular bevel.

4. A container as defined in claim 1, wherein said canister has an internally flat bottom at the periphery of which there is an annular shoulder for supporting a wafer of material above said bottom for modifying the behavior of a liquid in said canister.

* * * * *